United States Patent [19]

Schwartz

[11] Patent Number: 4,921,028

[45] Date of Patent: May 1, 1990

[54] DOOR HARDWARE COVER

[76] Inventor: Nathan H. Schwartz, 5996 Mitchell Rd., NW., Unit 15, Atlanta, Ga. 30328

[21] Appl. No.: 229,258

[22] Filed: Aug. 8, 1988

[51] Int. Cl.[5] ..... E05D 11/00

[52] U.S. Cl. ..... 150/155; 16/250; 16/DIG. 30; 16/DIG. 2

[58] Field of Search ..... 16/121, 250, 251, DIG. 2, 16/DIG. 30; 150/52 R, 52 K, 52 L, 154, 155; 70/455; 292/DIG. 2

[56] References Cited

U.S. PATENT DOCUMENTS

| | | | |
|---|---|---|---|
| 1,633,988 | 6/1927 | Jones | 16/DIG. 30 X |
| 3,306,643 | 2/1967 | Reed | 16/DIG. 30 X |
| 3,978,553 | 9/1976 | Honig | 150/52 C X |
| 4,142,565 | 3/1979 | Plunkett, Sr. | 150/52 R |
| 4,691,409 | 9/1987 | Torgerson et al. | 16/250 |

FOREIGN PATENT DOCUMENTS

| | | | |
|---|---|---|---|
| 550773 | 9/1956 | Belgium | 150/52 R |
| 305363 | 5/1955 | Switzerland | 16/1 R |

*Primary Examiner*—Richard K. Seidel
*Assistant Examiner*—James Miner
*Attorney, Agent, or Firm*—B. J. Powell

[57] ABSTRACT

A cover for door hardware which has a plastic sheet to be adhesively attached to the base of the door hardware and cover the door hardware while painting.

7 Claims, 3 Drawing Sheets

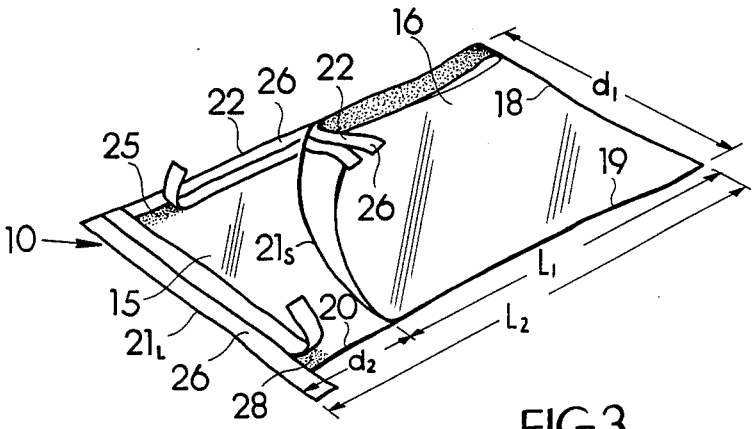
FIG.1
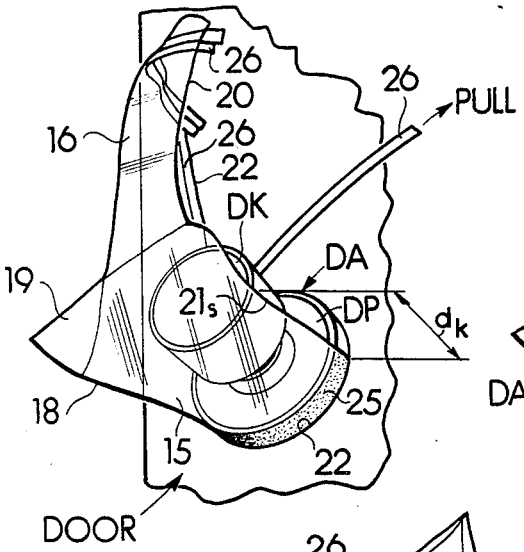
FIG.2
FIG.3
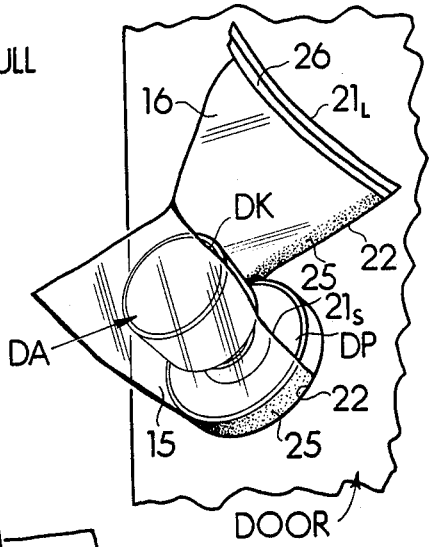
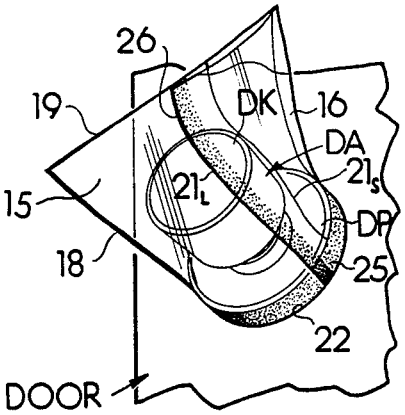
FIG.4

DOOR HARDWARE COVER

BACKGROUND OF THE INVENTION

This invention relates generally to paint protection devices and more particularly to temporary paint covers for door hardware.

Door hardware already installed on a door prior to painting is difficult to protect against paint being inadvertently applied to the hardware either by brushing, dropping or overspray. This is a problem when a space is being repainted and is typically a problem even in new construction since the door hardware is already applied to many prehung doors or since it is easier to install the door hardware prior to painting, and especially more economical from a building standpoint.

Heretofore, attempts have been made to paint close to the knob base plate, hinge and deadbolt escutcheon plate. This frequently results in paint being inadvertently brushed on these items which must subsequently be removed either by scraping or steel wooling. This also frequently damages the paint around the particular component which requires a repetition of the painting operation. When the door and/or wall around the door are painted by spraying, the overspray frequently settles on the various components of the door hardware. This requires that the door hardware be immediately wiped or the dried paint removed later by scraping or steel wooling. Again, not only is this unsatisfactory, but clean-up process is time consuming and expensive.

SUMMARY OF THE INVENTION

These and other problems and disadvantages associated with the prior art are overcome by the invention disclosed herein by the provision of a protective cover which can be used to temporarily cover the exposed sections of the door hardware, which can be easily and rapidly installed, which permits the doorknob to be operated while the cover is installed, and which prevents any paint from being inadvertently applied to the door hardware while the door and surrounding wall are painted.

The cover includes a pair of rectilinear plastic sheets overlying each other and joined along one common end and one common side edge so that one end of each of the sheets is free and one edge of each of the sheets is free whereby the free side edges of the sheets overlap each other. This allows the free side edges of the sheets to be attached around the edge of the door hardware adjacent the door while the connected side edges of the sheets span the door hardware. The free side edges with an adhesive are wrapped around the base of the door hardware until the free ends of the side sheets overlap each other and completely enclose the door hardware therein to prevent paint from inadvertently dropping onto the door hardware. The depth of the cover is selected so that the cover will fit around the door hardware without splitting, and, in the case of a doorknob, the depth of the cover is sufficiently greater than the projection of the knob from the door doorknob and part of the cover can be turned while still remaining enclosed in the cover. An adhesive may be preapplied to the free side edges of the sheets to facilitate the attachment of the free side edges to the base of the door hardware. Also, an adhesive may be preapplied to the overlapping free end of the side sheet so that the side sheets will stick to each other and form a seal.

These and other features and advantages of the invention will become more clearly understood upon consideration of the following detailed description and accompanying drawing wherein like characters of reference designate corresponding parts throughout the several views and in which:

BRIEF DESCRIPTION OF THE DRAWINGS

FIG. 1 is a perspective view illustrating a first embodiment of the invention;

FIGS. 2 and 3 illustrate the cover of FIG. 1 being installed;

FIG. 4 is a perspective view illustrating the cover of FIG. 1 installed;

These features and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 5:
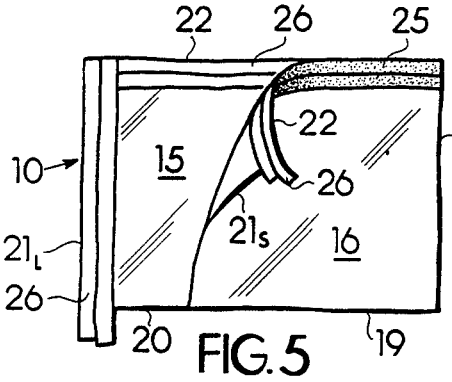
FIG. 5 is a plan view of the cover seen in FIG. 1.
Figure 6:
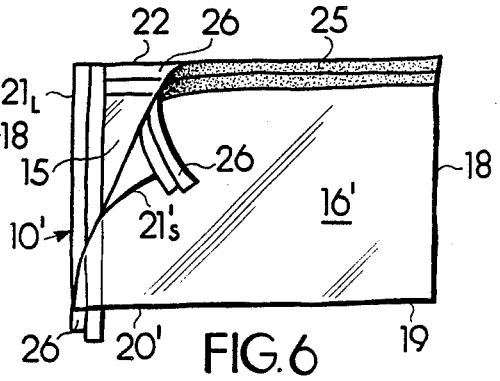
FIG. 6 is a plan view of a modified doorknob cover.
Figure 7:
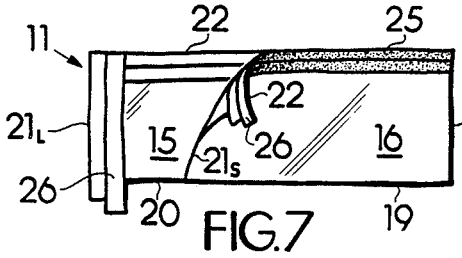
FIG. 7 is a plan view of a deadbolt cover.
Figure 8:
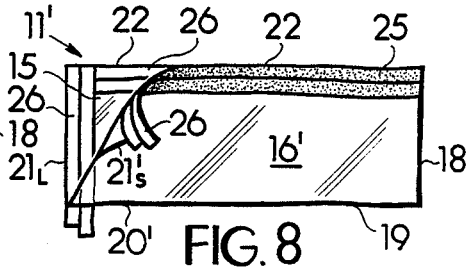
FIG. 8 is a plan view of a modified deadbolt cover.
Figure 9:
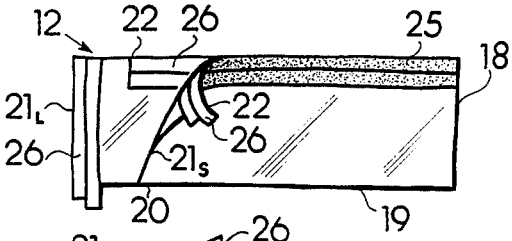
FIG. 9 is a plan view of a hinge cover.
Figure 10:
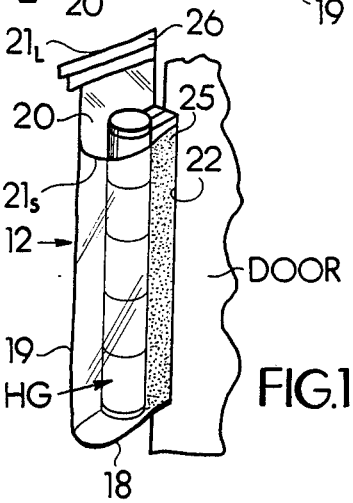
FIG. 10 is a perspective view illustrating the hinge cover being installed.
Figure 11:
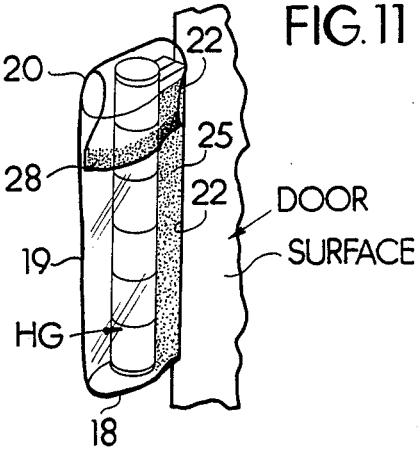
FIG. 11 is a perspective view illustrating the hinge cover installed.

Referring to the drawings, it will be seen that the inventions can be incorporated in a doorknob cover 10 seen in FIGS. 1–6; a deadbolt cover seen in FIGS. 7 and 8, and a hinge cover 12 seen in FIGS. 9–11. As is apparent, the cover 10 is used to cover doorknobs and door handles, the cover 11 is used to cover the escutcheon plate on deadbolt locks and the like, and the cover 12 is used to cover the exposed portions of hinges on the door.

Each of the covers 10–12 have a similar construction in that each has a long side sheet 15 over which is juxtaposed a short side sheet made out of a flexible material such as plastic, paper or the like. The long and short side sheets 15 and 16 have a common depth $d_1$ with the long side sheet 15 having a longer length $L_1$ than the short side length $L_2$. The difference between the two lengths is the distance $d_2$. The side sheets 15 and 16 are juxtaposed onto each other so as to form a common end edge 18 along one end thereof and a common side edge 19 along one side thereof. The common end and side edges 18 and 19 are joined together to maintain the sheets 15 and 16 in juxtaposition with each other as will become more apparent. It will also be appreciated that the long side sheet 15 has a projection side edge 20 projecting out past the end of the common side edge 19 as will become more apparent. This forms a free end edge 21 on each of the sheets 15 and 16, the end edge on the long side sheet being designated $\mathbf{21}_L$ while the end edge on the short side sheet is designated $\mathbf{21}_S$. This also forms free side edges 22 on the sheets 15 and 16. In FIG. 1, it will be seen that the end edges $\mathbf{21}_S$ and $\mathbf{21}_L$ do not overlie each other while the side edges 22 do overlie each other along the length of the short side sheet 16.

A side adhesive strip 25 is attached along the free side edges 22 of the sheets 15 and 16 so as to be continuous along the lengths thereof. The adhesive 25 is of the pressure sensitive type and is covered with an appropriate release strip 26. The end edge $21_L$ is provided with an adhesive strip 28 across the end thereof which is also provided with a release strip 26.

As will become more apparent, the depth $d_1$ is selected to be about 1.75 times the knob projection or greater. A distance $d_1$ about 2–2.5 times the knob projection $d_k$ have resulted in covers 10 easy to install on a doorknob assembly DA on doors. With the depth $d_1$ at the above mentioned dimensions, the doorknob DK can still be operated even though it is covered by the cover 10. The combined length $L_1$ and $L_2$ should be greater than the circumferential distance around the knob base or rose DP around the doorknob DK at the door surface. Typically, the base plate DP is circular with a diameter greater than the diameter of the doorknob DK. In any event, the combined lengths $L_1$ and $L_2$ should be greater than the largest diameter part on the doorknob assembly DA around which the cover 10 is to be placed. Preferably, the combined lengths $L_1$ and $L_2$ should be at least 1.25 times the circumference of the door plate DP to ensure overlapping of the sheet end edges $21_L$ and $21_S$.

FIG. 6 illustrates a modified form of the doorknob cover which has been designated 10'. The only difference between the cover 10 and 10' is that the short side sheet 16' has been extended so that it has the same length as the long side sheet 15. Thus, the modified side sheet 16' also has a free projection side edge 20' extending past the end of the common side edge 19. This cover 10' is installed in a similar manner to the cover 10 for the doorknob with sheets 15 and 16' overlapping further on cover 10' as will become more apparent.

INSTALLATION

The doorknob cover 10 is installed as illustrated in FIGS. 2–4 by first starting to strip away the release strip 26 covering the side adhesive strip 25 from that end of the adhesive strip 25 opposite the end adhesive strip 28. This allows the edge of the adhesive strip 25 to be applied to the edge of the door plate DP so that the free side edge 22 can be placed closely adjacent the door surface as the edge is adhesively attached to the door plate DP. It will be appreciated that the release strip 26 may be split so that one section of the release strip 26 may be removed at a time. Typically, when there are two portions to the release strip 26, the inboard portion of the strip 26 is removed prior to installation with the outboard portion being removed during installation. Proper holding of the release strip 26 adjacent the door surface and pulling thereon is illustrated in FIG. 2. It will be appreciated that the free side edge 22 of the short side sheet 16 will be first applied to the edge of the door plate followed by the application of the free side edge $22_S$ of the long side sheet 15 as seen in FIGS. 2 and 3. Finally, the release strip 26 is removed from the end adhesive strip 28 on the long side sheet 15 and the strip 28 pressed against the overlapped portion of the short side sheet 16 to seal them together. This is illustrated in FIG. 4. At this time, the additional depth of the doorknob cover 10 allows the cover to twist around the recess between the doorknob DK and the door plate DP to allow the user to rotate the knob to latch and unlatch the door.

The modified cover 10' is installed similarly. The ends 21 of the sheets 15' and 16' overlap more than with cover 10.

DEADBOLT COVER

The deadbolt cover 11 also includes the long and short side sheets 15 and 16 in juxtaposition with a common end edge 18 and a common side edge 19 which are joined together. The longer side sheet 15 has a projection side edge 20. The long side sheet 15 has a free edge end $21_L$ while the short side sheet 16 has the end edge $21_S$. Likewise a side adhesive strip 25 extends along the lengths of the free side edges 22 with an end adhesive strip 28 along the inside end edge $21_L$.

The depth $d_1$ on the deadbolt cover 11 does not need to be as great as that for the doorknob cover 10 since the deadbolt cover typically does not require the same degree of movement if the match mechanism is to be operated with the handle on the interior of the door. Therefore, the depth $d_1$ for the cover 11 is simply large enough to procide working clearance for the deadbolt and escutcheon plate EP. The combined lengths $L_1$ and $L_2$ should be at least slightly greater than the peripheral distance around the escutcheon plate EP and preferably at least 1.25 times that peripheral distance. The deadbolt cover 11 is installed in the same manner as the doorknob cover 10 and the explanation will not be repeated.

FIG. 8 illustrates a modified form of the deabolt cover which has been designated 11'. The only difference between the deadbolt covers 11 and 11' os that the short side sheet 16' has been extended so that it has the same length as the long side sheet 15. Thus, the modified side sheet 16' also has a free projection side edge 20' extending past the end of the common side edge 19. This cover 11' is installed in a similar manner to the modified cover 10' for the doorknob.

Figure 12:
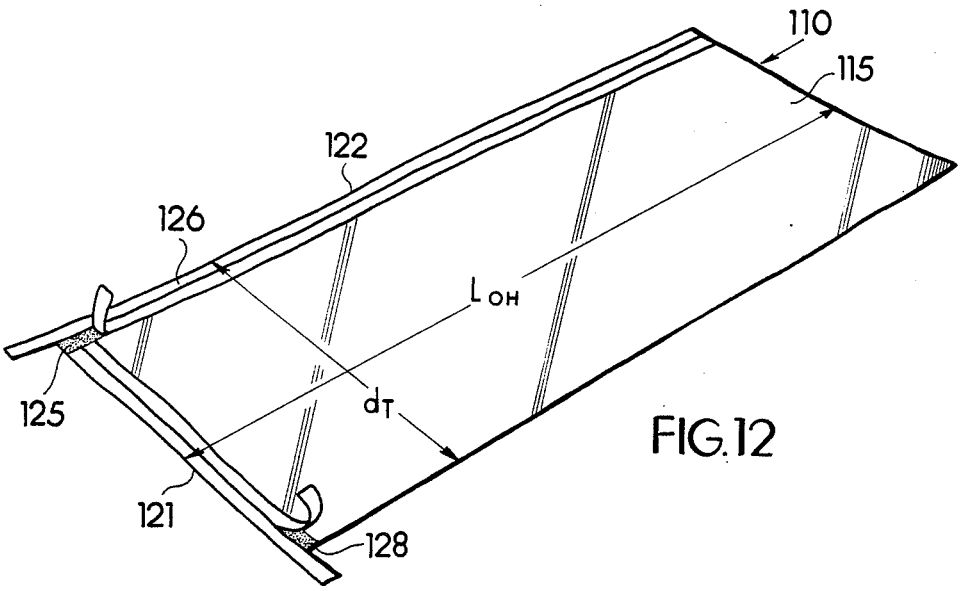
FIG. 12 is a perspective view illustrating an alternate doorknob cover.
Figure 13:
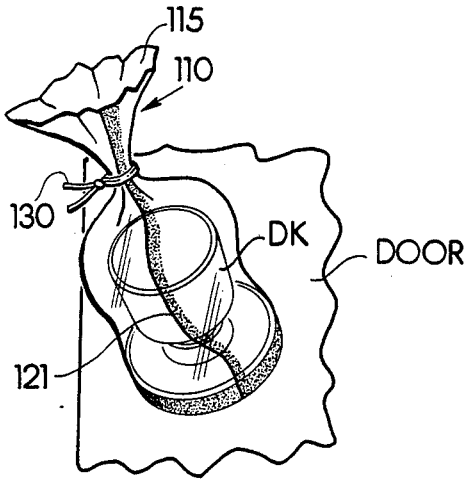
FIG. 13 is a perspective view illustrating the cover of FIG. 12 installed.

An alternate doorknob cover is illustrated in FIGS. 12 and 13 and has been designated 110. The cover 110 is a single elongate sheet 115 with an overall length $L_{OH}$ about the same as the sum of lengths $L_1$ and $L_2$ in the cover 10. The total depth $d_T$ is greater than depth $d_1$ of cover 10 as will become more apparent. One side edge 122 and one end edge 121 are provided with adhesive strips 125 and 128 respectively. Each strip 125 and 128 is covered with a release strip 126.

The cover 110 is installed by applying strip 125 around baseplate DP. The release strip 126 is removed from end strip 128 and the overlapped ends of sheet 115 adhesively bonded. A twist tie 130 closes the edge of the sheet 115 extending out past knob DK as seen in FIG. 13.

HINGE COVER

The hinge cover 12 is similar to the door knob cover 10 and deadbolt cover 11 except for size. The cover 12 has a long side sheet 15, and a short side sheet 16 joined together along a common end edge 18 and common side edge 19 so as to form a projection side edge 20 on that portion of the long side sheet 15 projecting beyond the end of the short side sheet 16. Thus, end edge $21_L$ is formed on the free end of the long side sheet 15 while end edge $21_S$ is formed on the free end of the short side sheet 16. Both of the sheets 15 and 16 have free side edges 22 thereon. The adhesive strip 25 for the side edges 22 extends therealong and may be covered with a release strip 26 and the end adhesive strip 28 is applied to the free end $21_L$ of the long side sheet 15.

In order to clear the projecting ends of the leaves and pins of the hinge HG as seen in FIGS. 10 and 11, the depth $d_1$ of the cover 12 should be greater than the maximum projection distance $d_H$ of the hinge. The length $L_2$ of the short sheet 16 should be about the same as the height $h_H$ of the hinge HG while the length $L_1$ of the long sheet 15 should be sufficiently longer than the height $h_H$ for the free end edge $\mathbf{21}_L$ on the long side sheet 15 can be folded over the end of the hinge HG to overlap the end edge $\mathbf{21}_S$.

FIG. 10 illustrates the first stage of the installation of the hinge cover 12 in which the release strip 26 covering the side adhesive strip 25 has been removed and the free side edges 22 attached to the leaves of the hinge HG closely adjacent the door surface. The release strip 26 covering the end adhesive strip 28 is then removed and the projecting portion of the long side sheet 15 lapped over the end edge $\mathbf{21}_S$ and adhesively applied thereto. Preferably, the hinge cover 12 is installed by placing the common end edge 18 under the bottom of the projecting portion of the hinge so that the exposed edge of the adhesive strip connecting the end edge $\mathbf{21}_L$ with the short side sheet 16 faces downwardly.

I claim:

1. A painting cover for a doorknob assembly on a door where the doorknob assembly includes a protruding doorknob and a base plate on the door through which the doorknob is mounted, the base plate having a base peripheral edge at the door surface and the doorknob assembly, including the base peripheral edge of the base plate, to be covered during painting so that paint does not get on the doorknob assembly, said cover including:

a pair of flexible rectilinear side sheets, each of said side sheets having opposed end edges and opposed side edges, said sheets having a common width and one of said sheets having a length greater than the other of said sheets, said side sheets joined to each other along one end edge to form a common end edge and along one side edge to form a common side edge, the other of said end edges and said side edges being unjoined to define free end edges on each of said side sheets opposite said common end edge and to form free side edges on each said side sheets opposite said common side edge, each of said side sheets defining an inside surface thereon facing said other sheet, said free side edges having a combined length greater than the length of said peripheral edge on said base plate; and, a pressure sensitive side adhesive strip applied to the inside surface of each of said side sheets along said free side edges thereon, said side adhesive strip extending along said side edges on said side sheets for a distance at least as great as the length of the peripheral edge of the base plate so that said adhesive strip will attach the free side edges of said sheets to the peripheral edge of the base plate with said sheets extending over the doorknob to cover both the base plate and the doorknob and with the longer end edge overlapping the shorter end edge as said side edges are wrapped around the peripheral edge of the base plate to enclose the door hardware therein to prevent paint being inadvertently applied thereto yet will allow the doorknob to be grasped and turned without disconnecting said cover from the base plate.

2. The cover of claim 1 wherein said side adhesive strip is removably covered by a release strip to prevent the side adhesive strip from inadvertently sticking to surfaces until ready for use.

3. The cover of claim 1 further including an end adhesive strip extending across the inside surface of the free end edge of said longer side sheets so that the overlapping longer free end edge is adhesively attached to the other said side sheet.

4. The cover of claim 3 further including a release strip removably covering said end adhesive strip.

5. The cover of claim 1 wherein said common width of said side sheets is at least 1.75 times the distance the doorknob projects from the door surface.

6. A painting cover for a doorknob assembly on a door where the doorknob assembly includes a protruding doorknob and a base plate on the door through which the doorknob is mounted, the base plate having a base peripheral edge at the door surface and the doorknob assembly, including the base peripheral edge of the base plate, to be covered during painting so that paint does not get on the doorknob assembly, said cover including:

a thin flexible rectilinear sheet having opposed end edges, opposed side edges and an inside surface, said sheet having a prescribed width at least twice as great as the distance the doorknob projects from the door surface and a length greater than the length of said peripheral edge on said base plate;

a pressure sensitive side adhesive strip applied to the inside surface of said sheet along one side edge thereon, said side adhesive strip extending along said side edge on said sheet for a distance at least as great as the length of the peripheral edge of the base plate so that said adhesive strip will attach the side edge of said sheet to the peripheral edge of the base plate with said sheet extending over the doorknob to cover both the base plate and the doorknob and with one end edge on said sheet overlapping the other end edge as said side edge is wrapped around the peripheral edge of the base plate; and, tie means for tying that portion of said sheet projecting past the door hardware to enclose the door hardware therein to prevent paint being inadvertently applied thereto yet will allow the doorknob to be grasped and turned without disconnecting said cover from the base plate.

7. The cover of claim 6 further including an end adhesive strip extending across the inside surface of one end edge of said sheet so that the overlapping end edge is adhesively attached to the outside of said side sheet.

* * * * *